United States Patent [19]

Matsuda

[11] 4,444,026

[45] Apr. 24, 1984

[54] WRAP-KNIT STRINGER TAPE FOR SLIDE FASTENERS

[75] Inventor: Yoshio Matsuda, Nyuzen, Japan

[73] Assignee: Yoshida Kogyo K.K., Tokyo, Japan

[21] Appl. No.: 352,324

[22] Filed: Feb. 25, 1982

[30] Foreign Application Priority Data

Feb. 26, 1981 [JP] Japan ..... 56-27433

[51] Int. Cl.[3] ..... D04B 7/16

[52] U.S. Cl. ..... 66/202; 66/196

[58] Field of Search ..... 66/196, 202, 190, 192, 66/193

[56] References Cited

U.S. PATENT DOCUMENTS

| | | | |
|---|---|---|---|
| 3,691,796 | 9/1972 | Mayer | 66/202 |
| 3,926,017 | 12/1975 | Matsuda | 66/195 |
| 3,965,833 | 6/1976 | Fröhlich et al. | 66/202 |
| 3,996,773 | 12/1976 | Matsuda | 66/195 X |
| 4,002,045 | 1/1977 | Fröhlich et al. | 66/202 |
| 4,043,007 | 8/1977 | Heimberger | 66/195 |
| 4,051,579 | 10/1977 | Heimberger | 66/195 |
| 4,134,185 | 1/1979 | Heimberger | 66/193 |
| 4,228,566 | 10/1980 | Matsuda | 66/195 X |
| 4,279,134 | 7/1981 | Matsuda | 66/195 |

*Primary Examiner*—Ronald Feldbaum

*Attorney, Agent, or Firm*—Hill, Van Santen, Steadman & Simpson

[57] ABSTRACT

A warp-knit stringer tape, for slide fasteners suitable for use on knit garments, has a double-faced structure having a plurality of wales on opposite sides. The stringer tape includes a longitudinally stretchable elongate web portion, and a longitudinal non-stretchable marginal portion extending along one longitudinal edge of the web portion for supporting a row of coupling elements of the slide fastener. In the web portion, textured yarns are used for a plurality of threads extending longitudinally of the wales and forming stitch loops therealong. In the marginal portion, a gray yarn having a coefficient of thermal shrinkage higher than that of the textured yarns is used for a core thread.

27 Claims, 17 Drawing Figures

WRAP-KNIT STRINGER TAPE FOR SLIDE FASTENERS

BACKGROUND OF THE INVENTION

1. Field of the Invention

The present invention relates to a warp-knit stringer tape for slide fasteners suitable for use on knit garments.

2. Prior Art

There are known various warp-knit stringer tapes for slide fasteners for use on knit garments such as cardigan sweaters which require the stringer tape not only to have a soft and smooth texture, but also to be stretchable, particularly longitudinally thereof. To this end, it has been proposed to use textured yarns in a warp-knit stringer tape in order to impart to the tape a smooth and soft texture. However, the prior stringer tape has only an inadequate degree of longitudinal stretchability, since the textured yarns are used only for the weft threads.

Yet, to use highly stretchable yarns in the knit structure of the tape causes the tape to become convex at one longitudinal edge along which a row of coupling elements is to be mounted. This is true because non-stretchable yarns must be used in the coupling-element-supporting tape edge portion in order to give it an adequate degree of mechanical strength and dimensional stability. From such curved tape it is difficult to obtain a proper slide fastener stringer, since the coupling-element-supporting tape edge portion is necessarily extended to become still more convex as a result of mounting the coupling elements therealong.

SUMMARY OF THE INVENTION

According to the present invention, a warp-knit stringer tape, for slide fasteners, has an elongate double-faced knit structure having a plurality of longitudinal wales on opposite sides. The double-faced knit structure includes a longitudinally stretchable elongate web portion, and a longitudinally non-stretchable marginal portion extending along one longitudinal edge of the web portion for supporting a row of coupling elements of the slide fastener. In the web portion, textured yarns are used for a plurality of threads extending longitudinally of the wales and forming stitch loops therealong. In the marginal portion, a gray yarn having a coefficient of thermal shrinkage higher than that of the textured yarns is used for a core thread.

It is therefore an object of the invention to provide a warp-knit stringer tape for slide fasteners which tape has both an adequate degree of longitudinal stretchability and a smooth and soft texture, thus making the slide fastener absolutely suitable to be used on a knit garment.

Many other advantages, features and additional objects of the present invention will become manifest to those versed in the art upon making reference to the detailed description and the accompanying drawings in which several preferred embodiments incorporating the principles of the present invention are shown by way of illustrative example.

DETAILED DESCRIPTION

Figure 1:
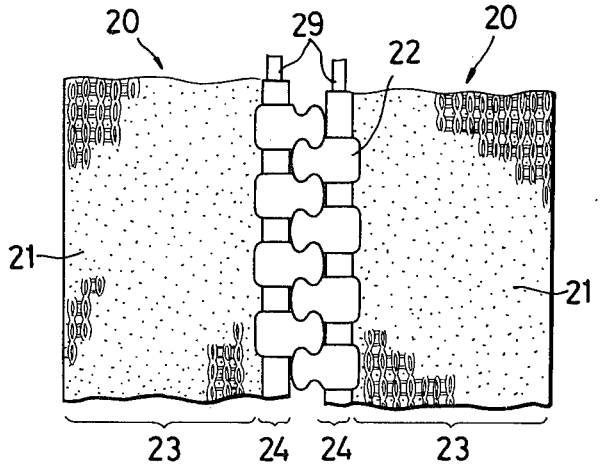
FIG. 1 is a fragmentary plan view of a pair of slide fastener stringers each including a warp-knit stringer tape according to the present invention.

FIG. 1 shows an interengaged pair of slide fastener stringers 20,20 each including a warp-knit stringer tape 21 supporting along one longitudinal edge thereof a row of coupling elements 22 secured to the stringer tape 21 in a manner described below. The stringer tape 21 has a longitudinally stretchable elongate web portion 23, and a longitudinally non-stretchable marginal portion 24 extending along one longitudinal edge of the web portion 23.

Figure 5:
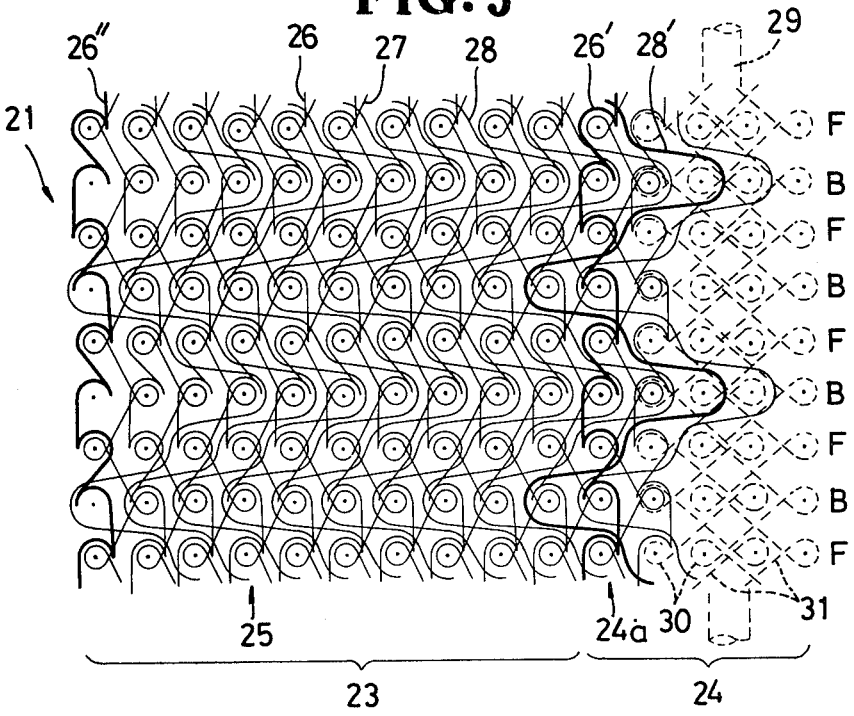
FIG. 5 is a point diagram showing a warp-knit fabric structure of the stringer tape according to a first embodiment.
Figure 6:
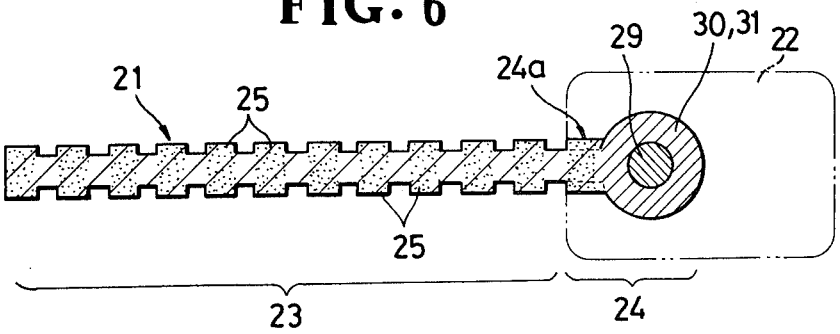
FIG. 6 is a schematic transverse cross-sectional view corresponding to FIG. 5.

As shown in FIGS. 5 and 6, the stringer tape 21 is made on a knitting machine having a pair of front and back guide bars F, B and hence the tape has a double-faced structure having a plurality of longitudinal wales 25 on opposite sides.

The web portion 23 includes a plurality of threads 26 knit as chain stitches having a pattern of 2-0/0-2/0-2/2-0, a plurality of threads 27 knit as tricot stitches having a pattern of 2-4/2-0/2-4/2-0, and a plurality of weft threads 28 laid in a pattern of 4-4/8-8/4-4/0-0. Each of the threads 26 of the chain stitches extends longitudinally of one of the wales 25 and has a succession of stitch loops therealong. The marginal portion 24 includes a core thread 29 laid in a pattern of 0-0/0-0/0-0/0-0, a plurality of threads 30 knit as tricot stitches in a pattern of 4-6/2-0/4-6/2-0, and a plurality of threads 31 knit as tricot stitches in a pattern of 2-0/4-6/2-0/4-6. The tricot stitches of the threads 30,31 surround the core thread 29 and are linked with the web portion 23. The threads 29, 30, 31 in this and other embodiments are shown in broken lines to improve clarity of illustration of construction. At the border 24*a* between the web portion 23 and the marginal portion 24, both one of the threads 26' and one of the weft threads 28' have a higher degree of strength than the other threads 26,27,28. An outermost one of the threads 26'' at the other tape edge remote from the marginal portion 24 also has a higher degree of strength than the other threads 26,27,28.

The threads 26,27,28 (solid lines in FIG. 5) comprise textured yarns. Preferably, the textured yarns are processed or twisted yarns of polyester and have a coefficient of thermal shrinkage of six to seven % at a temperature of 180° C. for 30 minutes. On the other hand, the threads 29,30,31 (broken lines in FIG. 5) at the marginal portion 24 comprise gray yarns. Preferably, the gray yarns are unfinished multifilament yarns of polyester and have a coefficient of thermal shrinkage of 15 to 16% at a temperature of 180° C. for 30 minutes.

Because the wales 25 on opposite sides of the web portion 23 are formed of textured yarns, the stringer tape 21 not only has a smooth and soft texture as if it were made of wool fibers, but also has an adequate degree of longitudinal stretchability. Thus the stringer tape 21 has literally the same appearance as knit wool garments.

Figure 2:
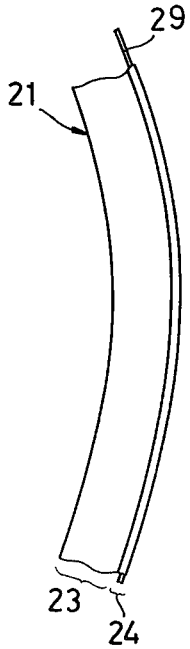
FIGS. 2, 3 and 4 are schematic fragmentary plan views showing the warp-knit stringer tape in different postures at different stages of manufacture of the slide fastener stringer.
Figure 3:
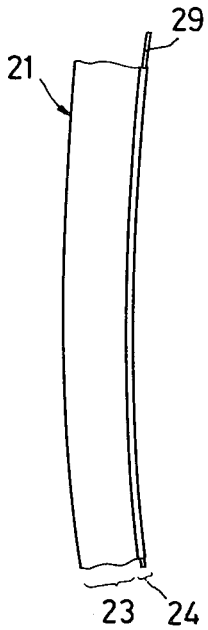
Figure 4:
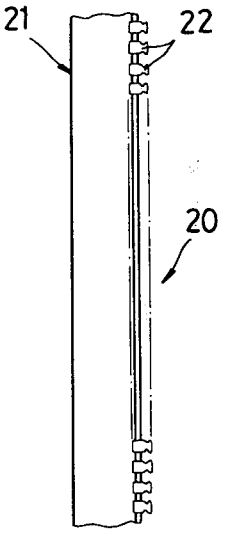

From the resultant stringer tape 21, a slide fastener stringer 20 is manufactured as follows. Before having been heat-set and dyed, the stringer tape 21 is appreciably convex at the marginal portion 24 (FIG. 2). The stringer tape 21 of FIG. 2 will then become slightly concave at the marginal portion 24 (FIG. 3) as the tape 21 is heat-set and dyed, since the gray yarns 29,30,31 at the marginal portion 24 have a higher shrinking percentage than the textured yarns 26,27,28 of the web portion 23. Finally a row of metallic or thermoplastic molded coupling elements 22 is mounted on and along the marginal portion 24, causing the latter to extend to such an extent that the stringer tape 21 becomes straight (FIG. 4). When the coupling elements 22 are made of thermoplastic material, they are injection-molded on and along the marginal portion 23, at which time the injected thermoplastic material penetrates into the interstices of the textured yarns at the border 24*a* between the web and marginal portions 24,24, thus securing the individual coupling elements 22 to the tape with increased firmness. The resultant slide fastener stringer 20 is suitable for use on knit garments such as cardigan sweaters made of wool fibers.

Figure 7:
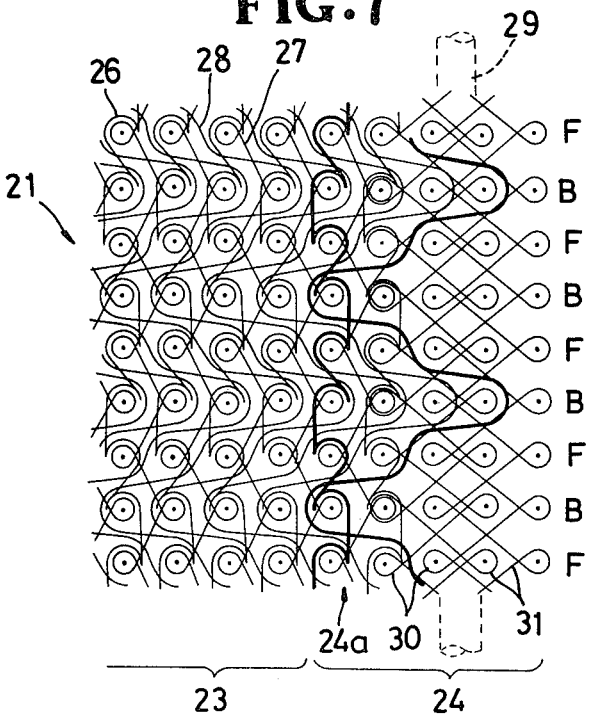
FIG. 7 is a fragmentary point diagram similar to FIG. 5, showing a modified stringer tape according to a second embodiment.
Figure 8:
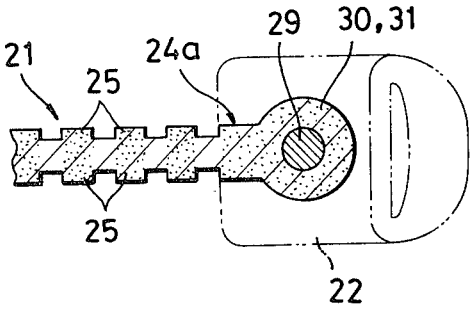
FIG. 8 is a schematic transverse cross-sectional view corresponding to FIG. 7.

FIGS. 7 and 8 illustrate a second embodiment similar to the embodiment of FIGS. 5 and 6, and the only difference therefrom is that textured yarns are used for the tricot stitches 30,31 (solid line in FIG. 7) at the marginal portion 24. Because of the textured yarns, the marginal portion 24 is bulky and thick. With this arrangement metallic molded coupling elements 22 can be attached to the tape 21 without breakage or other damage of the threads at the marginal portion.

Figure 9:
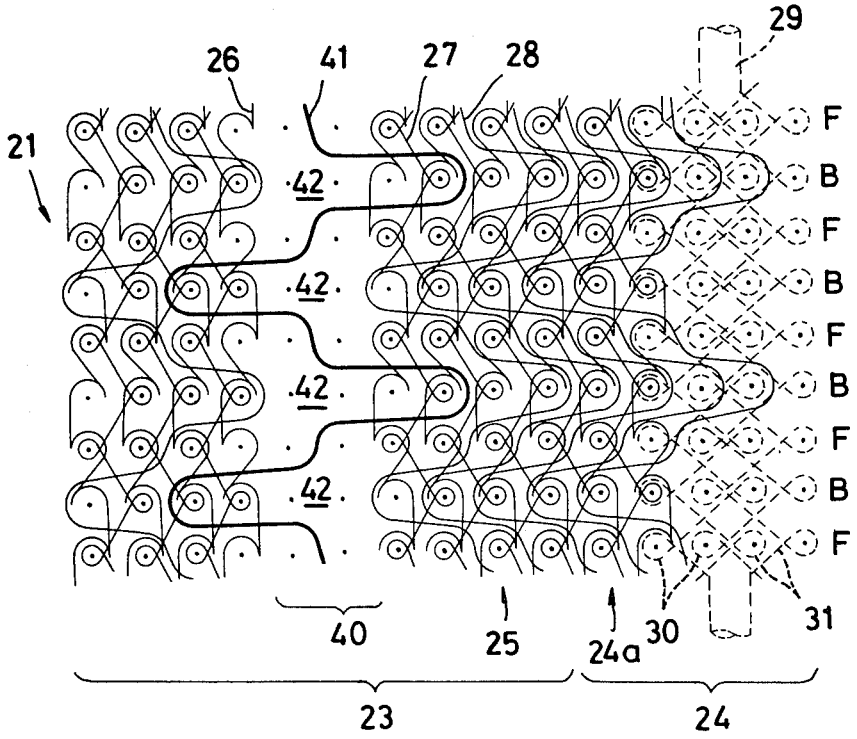
FIG. 9 is a point diagram showing a warp-knit fabric structure of a modified stringer tape according to a third embodiment.

FIG. 9 illustrates a third embodiment similar to FIG. 5, and the only difference therefrom is that the web portion 23 has a wale-free coarse region 40 which is devoid of two wales 25. A connector thread 41 is laid in a pattern of 6-6/12-12/6-6/0-0. The connector thread 41 thus laid in extends transversely across the wale-free coarse region 40, providing therealong a succession of openings 42. The wale-free coarse region 40 may be varied in width by selecting the number of wales 25 to be omitted.

Figure 10:
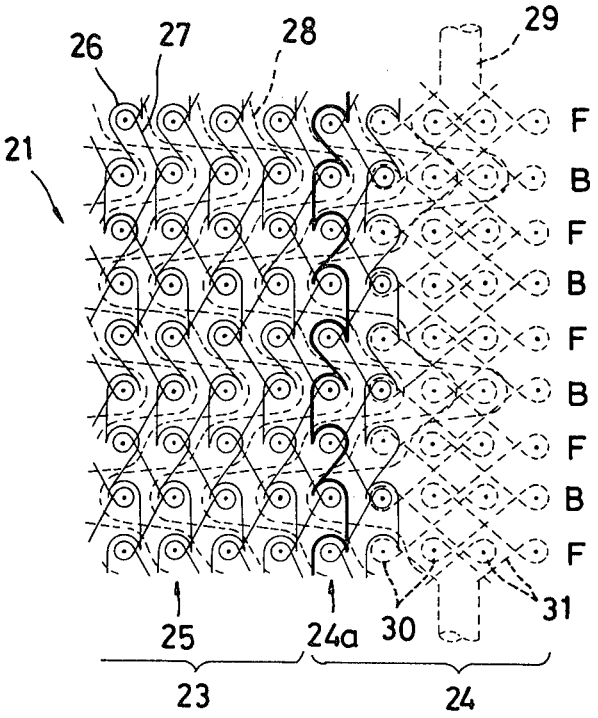
FIG. 10 is a fragmentary point diagram similar to FIG. 5, showing a fourth embodiment.
Figure 11:
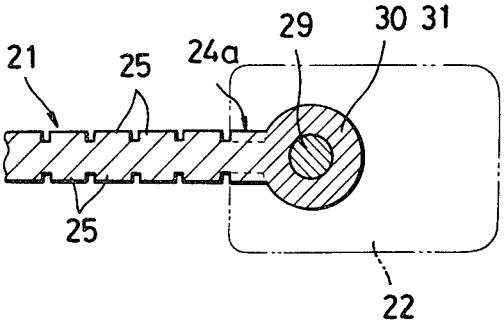
FIG. 11 is a schematic transverse cross-sectional view corresponding to FIG. 10.

FIGS. 10 and 11 illustrate a fourth embodiment similar to the embodiment of FIGS. 5 and 6, and the only difference therefrom is that gray yarns having a higher shrinking percentage than the textured yarns are used for the weft threads 28 (broken lines in FIG. 10). As the tape 21 is heat-set, the gray yarns 28 shrink so as to bring the adjacent wales 25 close to one another, thereby reducing interwale spaces. Thus the web portion 23 is almost wholly covered with textured yarns that form the wales 25 through the web portion 23, giving the tape 21 a very smooth and soft texture.

Figure 12:
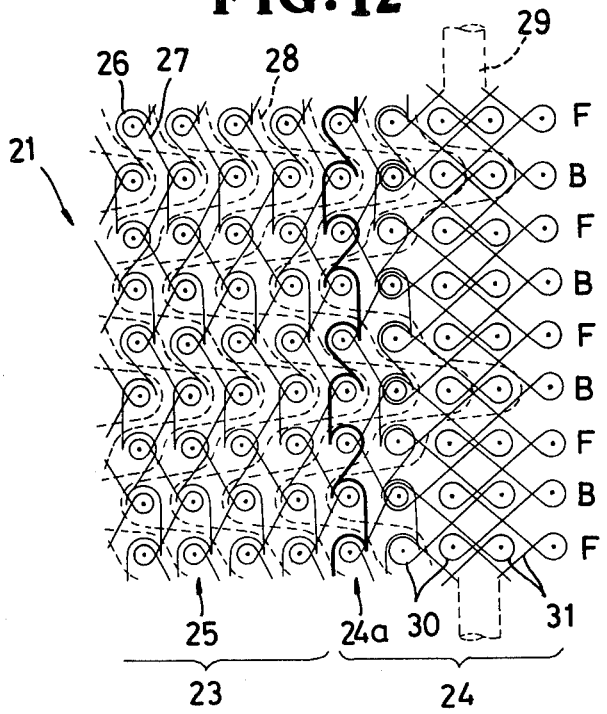
FIG. 12 is a fragmentary point diagram similar to FIG. 7, showing a fifth embodiment.
Figure 13:
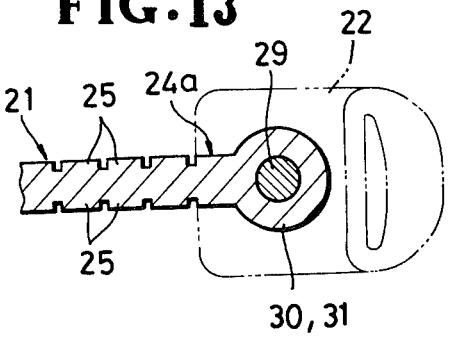
FIG. 13 is a schematic transverse cross-sectional view corresponding to FIG. 12.

FIGS. 12 and 13 illustrate a fifth embodiment similar to the embodiment of FIGS. 7 and 8, and the only difference therefrom is that gray yarns having a higher shrinking percentage than the textured yarns are used for the weft threads 28, producing the same results as the embodiment of FIGS. 10 and 11.

Figure 14:
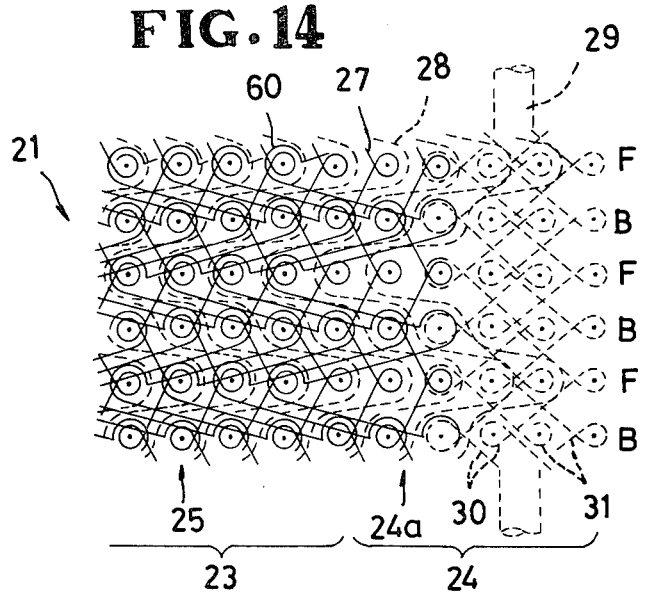
FIGS. 14, 15, 16 and 17 are point diagrams showing warp-knit fabric structures of modified stringer tapes according to sixth, seventh, eighth and ninth embodiments, respectively.

FIG. 14 illustrates a sixth embodiment similar to the embodiment of FIG. 10, and the only difference therefrom is that at the web portion 23 the chain stitches 26 are replaced by single cord stitches 60 of textured yarns knit in a pattern of 0-2/8-6/0-2/8-6.

Figure 15:
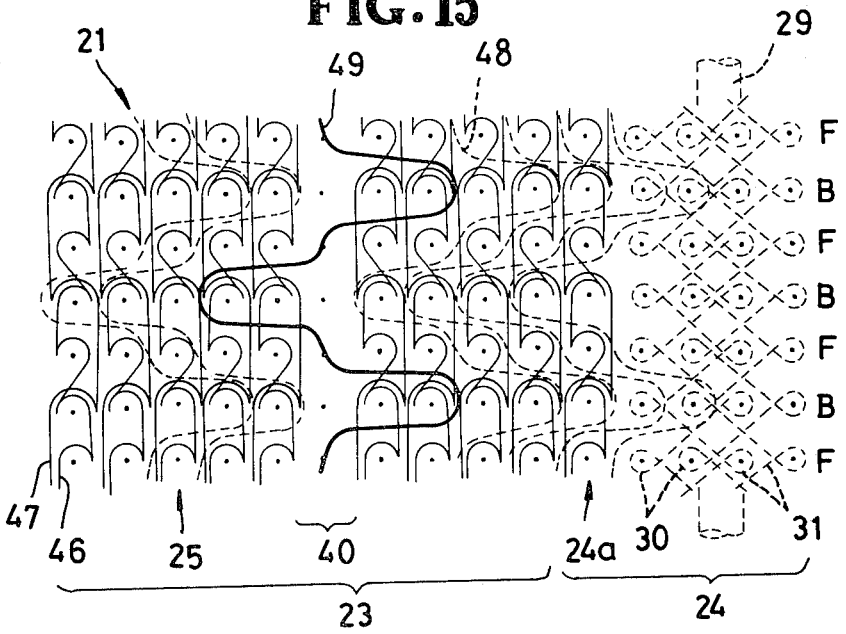

FIG. 15 illustrates a seventh embodiment in which the web portion 23 includes chain stitches 46 of textured yarns knit in a pattern of 2-0/0-2/0-2/2-0, chain stitches 47 of textured yarns knit in a pattern of 2-2/2-0/0-0/0-2, a plurality of weft threads 48 of gray yarns laid in a pattern of 4-4/8-8/4-4/0-0, and connector threads 49 of gray yarn laid in a pattern of 6-6/0-0/6-6/10-10.

Figure 16:
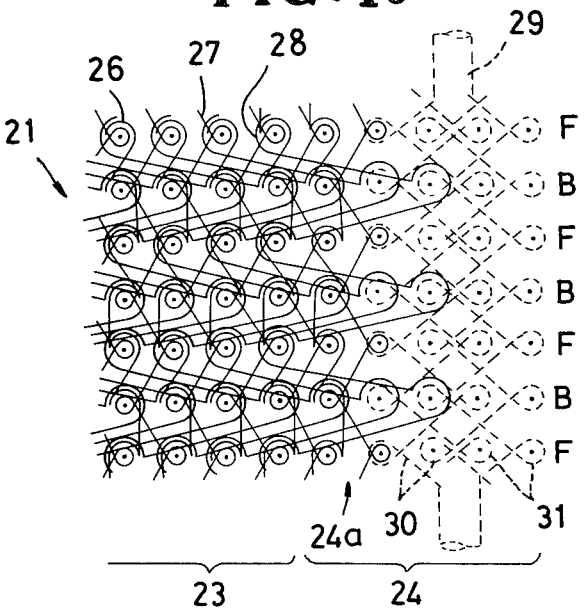

FIG. 16 illustrates an eighth embodiment similar to the embodiment of FIG. 10, and the only difference therefrom is that the web portion 23 includes, as a plurality of weft threads, single cord stitches 58 of textured yarns knit in a pattern of 0-2/8-6/0-2/8-6.

Figure 17:
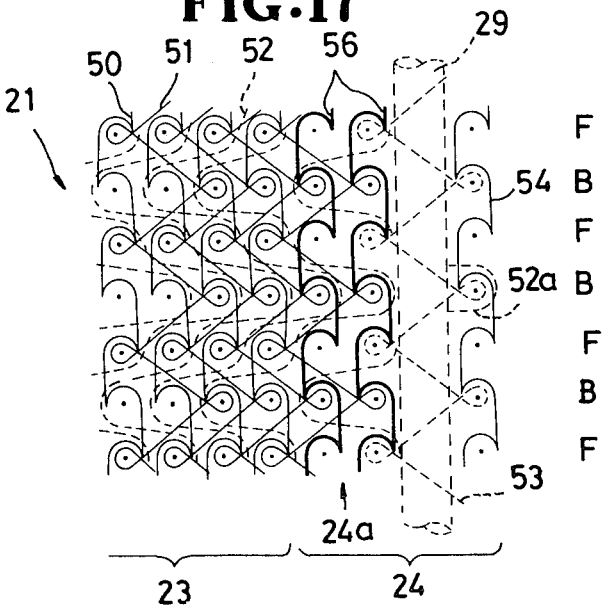

FIG. 17 illustrates a ninth embodiment in which the web portion 23 includes chain stitches 50 of textured yarns knit in a pattern of 2-0/0-2/2-O/O-2, tricot stitches 51 of textured yarns knit in a pattern of 4-6/2-0/4-6/2-0, and a plurality of weft threads 52 of gray yarns laid in a pattern of 4-4/8-4/4-4/0-0. At the marginal portion 24, the core thread 29 is surrounded by tricot stitches 53 of gray yarns extending over the cord thread 29 and having a pattern of 4-6/2-0/4-6/2-0, one of the weft threades 52*a* extending under the core thread 29, and chain stitches 54 at the innermost wale. Chain stitches 50,50 at an adjacent pair of border wales 56,56 comprises reinforced yarns.

In each of the embodiments described above, the stringer tape has a double-faced structure and hence has the wales on opposite sides, and these wales are formed of textured yarns. With this arrangement it is possible to impart to the tape a smooth and soft texture as if it were made of wool fibers. Thus the stringer tape has literally the same appearance as knit wool garments such as sweaters. For this reason, it is absolutely unnecessary to conceal the exposed tape portion when the tape is attached to the garment, requiring no special covering flap.

Further, partly because textured yarns have a relatively low shrinking percentage and hence the amount of permanent dimensional change is minimal when heat-set, and partly because the stitch loops of a double-faced structure are loose and hence the amount of permanent dimensional change is minimal, the web portion 23 has an adequate degree of stretchability.

Another advantageous feature of this stringer tape is that, because of the difference in shrinkage between textured and gray yarns, it is possible to make the tape concave at the marginal portion when heat-set during the dyeing step of manufacture of the slide fastener stringer. Therefore an accurate and straight slide fastener stringer can be obtained when a row of coupling elements is mounted on and along the marginal portion, at which time the latter is neccessarily extended.

The stringer tape thus constructed has a sufficient degree of stretchability throughout the web portion, making the slide fastener capable of being attached to a knit garment easily and properly, at which time the stringer tape can be put on a row of knitting needles of a linking machine without obstruction.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A warp-knit stringer tape for a slide fastener having a pair of rows of coupling elements, comprising:

(a) an elongate double-faced knit structure having a plurality of longitudinal wales on opposite sides, said double-faced knit structure including a longitudinally stretchable elongate web portion, and a longitudinally non-stretchable marginal portion extending along one longitudinal edge of said web portion for supporting one coupling element row of the slide fastener;

(b) said web portion including a plurality of first threads extending longitudinally of the wales and forming stitch loops therealong, said first threads comprising textured yarns; and (c) said marginal portion including a core thread extending longitudinally therealong, and a plurality of second threads surrounding said core thread and linked with said web portion, said core thread and said second threads comprising gray yarns having a coefficient of thermal shrinkage higher than that of the textured yarns.

2. A warp-knit stringer tape according to claim 1, said second threads comprising textured yarns.

3. A warp-knit stringer tape according to claim 1, said double-faced knit structure including a plurality of third threads each extending transversely across those of adjacent ones of said wales which comprise the border between said stretchable web and non-stretchable marginal portions, said third threads comprising gray yarns having a coefficient of thermal shrinkage higher than that of said textured yarns.

4. A warp-knit stringer tape according to claim 1, said first threads being knit as chain stitches.

5. A warp-knit stringer tape according to claim 1, said first threads being knit as single cord stitches.

6. A warp-knit stringer tape according to claim 1, said web portion further including a plurality of fourth threads knit as tricot stitches, said fourth threads comprising textured yarns.

7. A warp-knit stringer tape according to claim 4, said third threads being laid in a pattern of 4-4/8-8/4-4/0-0.

8. A warp-knit stringer tape according to claim 4, said third threads being laid in a pattern of 4-4/8-8/4-4/0-0.

9. A warp-knit stringer tape according to claim 5, said chain stitches of said first threads having a pattern of 2-0/0-2/0-2/2-0.

10. A warp-knit stringer tape according to claim 5, said single cord stitches of said first threads having a pattern of 0-2/8-6/0-2/8-6.

11. A warp-knit stringer tape according to claim 1, said second threads being knit as tricot stitches having a pattern of 4-6/2-0/4-6/2-0.

12. A warp-knit stringer tape according to claim 1, said second threads being knit as tricot stiches having a pattern of 2-0/4-6/2-0/4-6.

13. A warp-knit stringer tape according to claim 6, said tricot stitches of said fourth threads having a pattern of 2-4/2-0/2-4/2-0.

14. A warp-knit stringer tape according to claim 6, said tricot stitches of said fourth threads having a pattern of 4-6/2-0/4-6/2-0.

15. A warp-knit stringer tape according to claim 1, said web portion further including a plurality of fifth threads each extending transversely across a plurality of adjacent ones of said wales, said fifth threads comprising gray yarns having a coefficient of thermal shrinkage higher than that of the textured yarns.

16. A warp-knit stringer tape according to claim 1, said web portion further including a plurality of fifth threads each extending transversely across a plurality of adjacent ones of said wales, said fifth threads being laid in a pattern of 4-4/8-8/4-4/0-0.

17. A warp-knit stringer tape according to claim 1, said web portion further including a plurality of fifth threads each extending transversely across a plurality of adjacent ones of said wales, said fifth threads being laid in a pattern of 4-4/6-6/4-4/0-0.

18. A warp-knit stringer tape according to claim 1, said web portion further including a plurality of fifth threads each extending transversely across a plurality of adjacent ones of said wales, said fifth threads being knit as single cord stitches having a pattern of 0-2/8-6/0-2/8-6.

19. A warp-knit stringer tape according to claim 1, said textured yarns having a coefficient of thermal shrinkage of six to seven % at a temperature of 180° C. for 30 minutes.

20. A warp-knit stringer tape according to claim 1, said gray yarns having a coefficient of thermal shrinkage of 15 to 16% at a temperature of 180° C. for 30 minutes.

21. A warp-knit stringer tape according to claim 1, at least one of said first threads at the border between said web and marginal portions being a warp thread having a higher degree of strength than the other first threads.

22. A warp-knit stringer tape according to claim 2, said textured yarns having a coefficient of thermal shrinkage of 6 to 7 percent at a temperature of 180° C. for 30 minutes.

23. A warp-knit stringer tape according to claim 3, said textured yarns having a coefficient of thermal shrinkage of 6 to 7 percent at a temperature of 180° C. for 30 minutes.

24. A warp-knit stringer tape according to claim 6, said textured yarns having a coefficient of thermal shrinkage of 6 to 7 percent at a temperature of 180° C. for 30 minutes.

25. A warp-knit stringer tape according to claim 3, said gray yarns having a coefficient of thermal shrinkage of 15 to 16 percent at a temperature of 180° C. for 30 minutes.

26. A warp-knit stringer tape according to claim 4, said gray yarns having a coefficient of thermal shrinkage of 15 to 16 percent at a temperature of 180° C. for 30 minutes.

27. A warp-knit stringer tape according to claim 15, said gray yarns having a coefficient of thermal shrinkage of 15 to 16 percent at a temperature of 180° C. for 30 minutes.

* * * * *